US010307036B2

(12) United States Patent
Watson et al.

(10) Patent No.: US 10,307,036 B2
(45) **Date of Patent: *Jun. 4, 2019**

(54) WAREWASH MACHINE WITH REMOVABLE ROTATING ARM AND RELATED METHOD

(71) Applicant: PREMARK FEG L.L.C., Glenview, IL (US)

(72) Inventors: Michael T. Watson, Beavercreek, OH (US); Brian A. Brunswick, Tiipp City, OH (US); Jeffrey R. Newcomer, Troy, OH (US); Gonska Heinrich, Offenburg (DE); Roland Walz, Hohberg (DE)

(73) Assignee: PREMARK FEG L.L.C., Glenview, IL (US)

( * ) Notice: Subject to any disclaimer, the term of this patent is extended or adjusted under 35 U.S.C. 154(b) by 11 days.

This patent is subject to a terminal disclaimer.

(21) Appl. No.: 15/682,127

(22) Filed: Aug. 21, 2017

(65) Prior Publication Data

US 2017/0340186 A1 Nov. 30, 2017

Related U.S. Application Data

(62) Division of application No. 13/738,877, filed on Jan. 10, 2013, now Pat. No. 9,763,554.

(Continued)

(51) Int. Cl.

| | |
|---|---|
| ***A47L 15/23*** | (2006.01) |
| ***A47L 15/42*** | (2006.01) |
| *A47L 15/00* | (2006.01) |

(52) U.S. Cl.

CPC ..... *A47L 15/428* (2013.01); *A47L 15/23* (2013.01); *A47L 15/0078* (2013.01)

(58) Field of Classification Search

CPC ..... A47L 15/18; A47L 15/20; A47L 15/22; A47L 15/23; A47L 15/14; A47L 15/16; B08B 9/34

(Continued)

(56) References Cited

U.S. PATENT DOCUMENTS

| | | | |
|---|---|---|---|
| 2,063,746 | A | 11/1936 | Meeker |
| 2,073,521 | A | 3/1937 | Johnston et al. |

(Continued)

FOREIGN PATENT DOCUMENTS

| | | |
|---|---|---|
| DE | 1503901 | 7/1969 |
| DE | 1920575 | 11/1970 |

(Continued)

OTHER PUBLICATIONS

DE102008011743—Machine Translation (Year: 2009).*

(Continued)

*Primary Examiner* — Marc Lorenzi

(74) *Attorney, Agent, or Firm* — Thompson Hine LLP

(57) ABSTRACT

A warewash machine arm mechanism includes a liquid supply shaft assembly including a rotatable sleeve bearing mounted thereon, and an arm assembly including an elongated interior liquid flow space along an arm body and one or more liquid ejection orifices. The arm assembly is releasably mounted to the supply shaft assembly via a latch mechanism of the arm assembly that engages the rotatable sleeve bearing such that the arm assembly rotates with the rotatable sleeve bearing during ejection of liquid from the liquid ejection orifices.

9 Claims, 10 Drawing Sheets

Related U.S. Application Data

(60) Provisional application No. 61/598,695, filed on Feb. 14, 2012.

(58) Field of Classification Search
USPC ..... 285/190
See application file for complete search history.

(56) References Cited

U.S. PATENT DOCUMENTS

| | | | |
|---|---|---|---|
| 2,128,008 | A | 8/1938 | Meeker |
| 2,158,904 | A | 5/1939 | Meeker et al. |
| 2,217,705 | A | 10/1940 | Rataicsak et al. |
| 2,229,663 | A | 1/1941 | Meeker et al. |
| 2,637,595 | A | 5/1953 | Fox |
| 2,707,961 | A | 5/1955 | Geiger et al. |
| 2,947,311 | A | 8/1960 | Fox et al. |
| 3,049,391 | A | 8/1962 | Meeker et al. |
| 3,141,618 | A | 7/1964 | Haas |
| 3,568,935 | A | 3/1971 | Hoffman |
| 3,695,283 | A | 10/1972 | Ringwall |
| 3,706,317 | A | 12/1972 | Fox et al. |
| 3,918,644 | A | 11/1975 | Platt et al. |
| 3,941,139 | A | 3/1976 | Spiegel |
| 4,014,467 | A | 3/1977 | Ferguson |
| 4,018,239 | A | 4/1977 | Caldwell et al. |
| 4,107,990 | A | 8/1978 | Rngwall |
| 4,157,161 | A | 6/1979 | Bauer |
| 4,187,122 | A | 2/1980 | Query |
| 4,210,285 | A | 7/1980 | Dicken et al. |
| RE30,537 | E | 3/1981 | Fraula et al. |
| 4,257,559 | A | 3/1981 | Noren |
| 4,325,235 | A | 4/1982 | Bauer et al. |
| 4,418,868 | A | 12/1983 | Gurubatham et al. |
| 4,439,242 | A | 3/1984 | Hadden |
| 4,463,904 | A | 8/1984 | Bray, Jr. |
| 4,561,904 | A | 12/1985 | Eberhardt, Jr. |
| 4,657,188 | A | 4/1987 | Crane et al. |
| 4,869,428 | A | 9/1989 | Gombar |
| 5,197,673 | A | 3/1993 | Sullivan |
| 5,267,582 | A | 12/1993 | Purtilo |
| 5,383,486 | A | 1/1995 | Warner et al. |
| 5,464,482 | A | 11/1995 | Michael et al. |
| 5,657,878 | A * | 8/1997 | Austin ..... A47L 15/504 211/208 |
| 5,662,744 | A | 9/1997 | Tuller et al. |
| 5,725,002 | A | 3/1998 | Payzant |
| 5,906,317 | A | 5/1999 | Srinath |
| 5,927,616 | A | 7/1999 | Grise et al. |
| 5,967,418 | A | 10/1999 | MacDonald et al. |
| 6,110,292 | A | 8/2000 | Jewett et al. |
| 6,315,221 | B1 | 11/2001 | Goenka et al. |
| 6,325,083 | B1 | 12/2001 | Worter |
| 6,371,138 | B1 | 4/2002 | Kamota et al. |
| 6,467,476 | B1 | 10/2002 | Ivri et al. |
| 6,550,607 | B1 | 4/2003 | Watson et al. |
| 6,736,340 | B1 | 5/2004 | Wang |
| 6,739,526 | B2 | 5/2004 | Wlodarczyk |
| 6,964,090 | B2 | 11/2005 | Mathieu et al. |
| 7,083,121 | B2 | 8/2006 | Huffman |
| 7,314,188 | B2 | 1/2008 | Watson et al. |
| 9,763,554 | B2 * | 9/2017 | Watson ..... A47L 15/428 |
| 2004/0107598 | A1 | 6/2004 | Hwang |
| 2004/0111916 | A1 | 6/2004 | Hwang |
| 2006/0054204 | A1 | 3/2006 | Fischer |

FOREIGN PATENT DOCUMENTS

| | | |
|---|---|---|
| DE | 1957141 | 2/1971 |
| DE | 2534261 | 4/1976 |
| DE | 9209962 U1 | 11/1993 |
| DE | 4230054 A1 | 1/1994 |
| DE | 19544985 | 6/1996 |
| DE | 19812329 C1 | 6/1999 |
| DE | 102008011743 | 9/2009 |
| DE | 102009057461 | 8/2011 |
| EP | 2556781 | 2/2013 |
| WO | WO 2013/122893 | 8/2013 |

OTHER PUBLICATIONS

DE102009057461—Machine Translation (Year: 2011).*

PCT, International Search Report and Written Opinion, International Application No. PCT/US2013/025658; dated Apr. 24, 2013, 9 pages.

* cited by examiner

WAREWASH MACHINE WITH REMOVABLE ROTATING ARM AND RELATED METHOD

CROSS-REFERENCES

This application is a divisional of U.S. application Ser. No. 13/738,877, filed Jan. 10, 2013, which in turn claims the benefit of U.S. Provisional Application Ser. No. 61/598,695, filed Feb. 14, 2012, both incorporated herein by reference.

TECHNICAL FIELD

The present application relates generally to machines used to wash kitchen wares such as dishes, glasses, utensils, pots, and pans; and more particularly to a rotatable warewash arm construction for such machines.

BACKGROUND

Box-type warewash machines (aka batch-type machines) utilize rotating warewash arms to deliver liquid onto wares in a wash chamber during the wash process. The warewash arms typically are mounted onto a fluid supply shaft. In the past, the warewash arms were permanently mounted on the supply shaft such that replacement of the warewash arm requires removing the supply shaft from the warewash machine with tools. Such rotating arms could also be used in various zones within the elongated chambers of conveyor-type machines, though more commonly conveyor-type machines utilize fixed arms.

Accordingly, it would be desirable to provide a mechanism that allows a rotating warewash arm to be easily attached and removed by the user without tools. It would also be desirable to provide a liquid supply shaft, attachable to the rotating warewash arm, that allows for less wear than the present state of the art.

SUMMARY

In one aspect, a warewash machine arm mechanism includes a liquid supply shaft assembly including a rotatable sleeve bearing mounted thereon, and an arm assembly including an elongated interior liquid flow space along an arm body and one or more liquid ejection orifices. The arm assembly is releasably mounted to the supply shaft assembly via a latch mechanism of the arm assembly that engages the rotatable sleeve bearing such that the arm assembly rotates with the rotatable sleeve bearing during ejection of liquid from the liquid ejection orifices.

In one implementation of the arm mechanism of the preceding paragraph, the liquid supply shaft assembly extends downward, the arm assembly is a rinse arm assembly, and a wash arm assembly is also mounted on the liquid supply shaft assembly, the wash arm assembly supported on the supply shaft assembly by the rinse arm assembly.

In the implementation of the preceding paragraph, the arm assembly may include a bushing having a lower portion extending downward from an arm body of the wash arm assembly, the bushing including a downwardly facing bearing surface that sits atop an upper portion of the rinse arm assembly to facilitate relative rotation between the rinse arm assembly and the wash arm assembly.

In the arm mechanism of any of the three preceding paragraphs, the rotatable sleeve bearing may be fixed against axial removal from the supply shaft assembly.

In the arm mechanism of any of the four preceding paragraphs, the rotatable sleeve bearing may include a recessed exterior surface portion that is engaged by the latch mechanism.

In the arm mechanism of any of the five preceding paragraphs, the arm assembly may include a mount hub with a mount opening disposed about the liquid supply shaft assembly, and the latch mechanism includes at least first and second actuators, each actuator having an interior end portion biased toward an axis of the mount opening and an exterior end portion biased away from the axis, such that movement of the exterior end portion of the actuator toward the axis moves the interior end portion away from the axis.

In the arm mechanism of the preceding paragraph, a lower end portion of the supply shaft assembly may include a chamfer such that as the mount hub is moved axially onto the supply shaft assembly during assembly, the chamfer engages the interior end portion of each actuator forcing the end portion outward to permit the mount hub to slide onto the supply shaft assembly.

In the arm mechanism of any of the seven preceding paragraphs, where the arm assembly is a rinse arm assembly, a tubular wall of the supply shaft assembly may include at least one port therethrough for delivering rinse liquid to an interface between an external surface of the tubular wall and an internal surface of the rotatable sleeve bearing in order to lubricate the interface with the rinse liquid.

In the arm mechanism of any of the eight preceding paragraphs, the external surface of the tubular wall may include a peripherally extending groove and an external side of the port is located in the groove to facilitate movement of rinse liquid circumferentially about the interface.

A warewash machine including the arm mechanism of any of the nine preceding paragraphs may be formed with a chamber for receiving wares to be washed and a fluid path that is connected for delivering rinse liquid to the supply shaft assembly.

In another aspect, a warewash machine arm for ejecting liquid in a warewash machine includes an arm body formed to provide an elongated liquid space along an arm axis, the arm body including one or more liquid ejection orifices. A mount hub is connected to the arm body and includes a mount opening and at least first and second actuators. Each actuator has an interior end portion biased toward an axis of the mount opening and exterior end portion biased away from the axis, such that movement of the exterior end portion of the actuator toward the axis moves the interior end portion away from the axis.

In the arm of the preceding paragraph, at least one compression spring may be compressed between portions of the first and second actuators to provide the biased arrangement.

In the arm of either of the two preceding paragraphs, the exterior end portions of the actuators may be diametrically opposed to each other.

In a warewash machine including the arm of any of the three preceding paragraphs, the machine may further include a supply shaft assembly including a rotatable sleeve bearing, the arm mounted to the rotatable sleeve bearing via the actuators engaging the rotatable sleeve bearing.

In the warewash machine of the preceding paragraph, the rotatable sleeve bearing may be mounted about a hollow axle shaft having an end portion configured to prevent axial removal of the rotatable sleeve bearing.

In the warewash machine of either of the two preceding paragraphs, the supply shaft assembly may extend downward from an upper portion of the warewash machine, the arm is a rinse arm, and a wash arm assembly is also mounted on the supply shaft assembly, the wash arm assembly supported on the supply shaft assembly by the rinse arm.

In the warewash machine of the preceding paragraph, the wash arm assembly may include a bushing having a lower portion extending downward from an arm body of the wash arm assembly, the bushing including a downwardly facing bearing surface that sits atop an upper portion of the arm mount hub.

In a further aspect, a method of spraying liquid onto wares within a chamber of a warewash machine includes the steps of: utilizing an elongated arm body with multiple spray nozzles thereon and a releasable latch mechanism connected thereto; utilizing a supply shaft assembly having a rotatable sleeve bearing thereon that is supported against axial removal from the supply shaft assembly; mounting the elongated arm body onto the supply shaft assembly by engaging the releasable latch mechanism with the rotatable sleeve bearing; flowing liquid through the supply shaft assembly and into the arm body such that the liquid is sprayed from the nozzles as the arm body rotates; where the releasable latch mechanism engages the rotatable sleeve bearing to cause the rotatable sleeve bearing to rotate with the arm body.

In the foregoing method, the releasable latch mechanism may have a biased position, the mounting step involves moving the releasable latch mechanism over an end of the supply shaft assembly and into alignment with the rotatable sleeve bearing, and during such movement an end portion of the supply shaft assembly slidingly interacts with a portion of the releasable latch mechanism to move the releasable latch mechanism out of its biased position to permit mounting.

In the method of either of the two preceding paragraphs, a wall of the supply shaft assembly may include at least one port therethrough for delivering liquid to an interface between an external surface of the tubular wall and an internal surface of the rotatable sleeve bearing in order to lubricate the interface with the liquid as the rotatable sleeve bearing rotates.

In the method of any of the three preceding paragraphs, the external surface of the wall may include a peripherally extending groove and an external side of the port is located in the groove to facilitate movement of rinse liquid circumferentially about the interface.

In yet another aspect, a warewash machine arm for ejecting liquid in a warewash machine includes an arm body defining an elongated liquid and at least one orifice disposed along the arm body. To the arm is removably attached a warewash arm mount hub. Two resiliently biased actuators are symmetrically disposed about the hub.

The details of one or more embodiments are set forth in the accompanying drawings and the description below. Other features, objects, and advantages will be apparent from the description and drawings, and from the claims.

DETAILED DESCRIPTION

Figure 1:
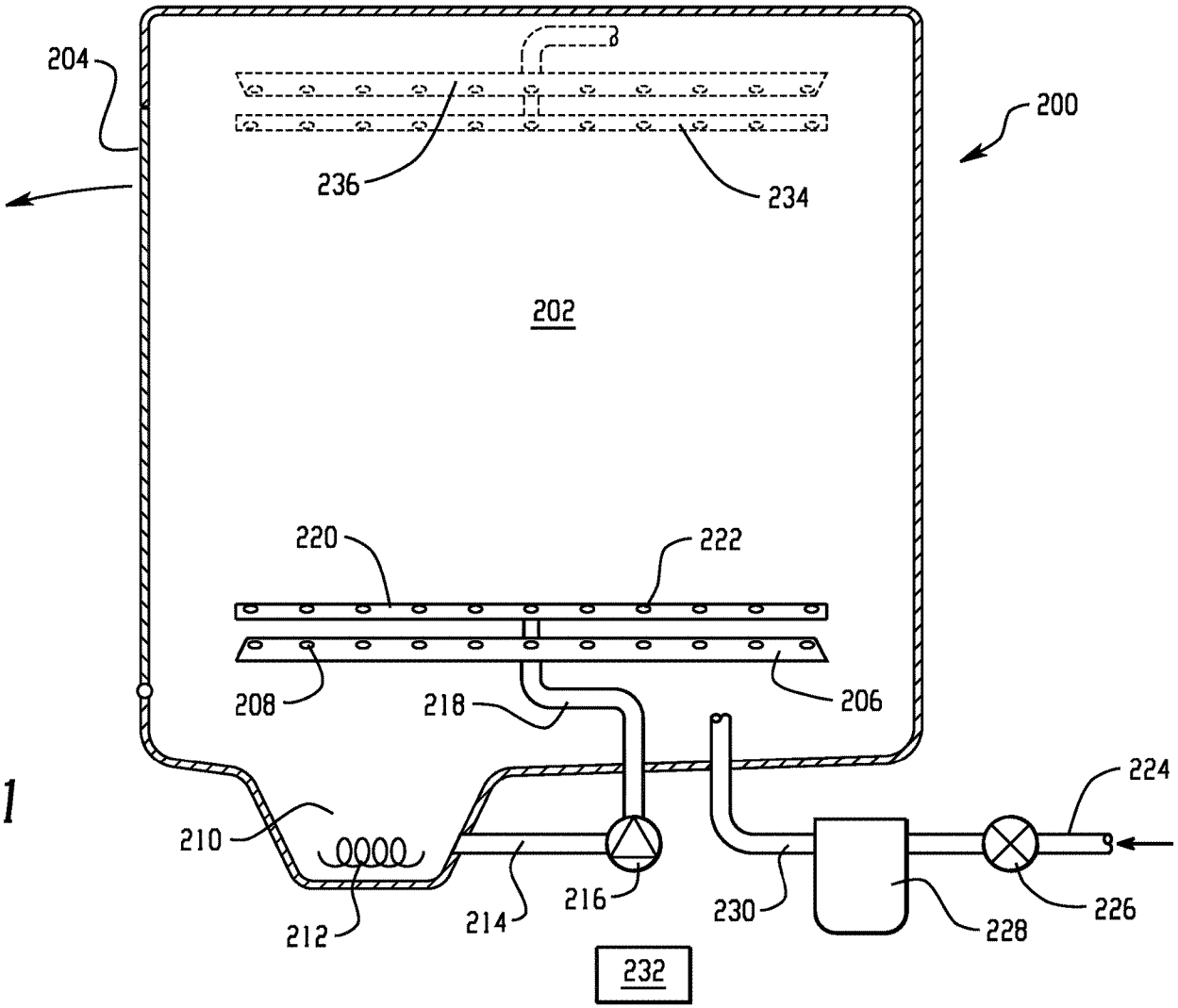
FIG. 1 is a schematic depiction of a batch-type warewasher.

Referring to FIG. 1, a schematic depiction of an exemplary batch-type warewasher 200 is shown, and includes a chamber 202 in which wares are placed for cleaning via opening of a pivoting access door 204. At the bottom of the chamber 202, a rotatable wash arm 206 is provided and includes multiple nozzles 208 that eject wash liquid during a cleaning operation. The wash liquid contacts the wares for cleaning and then falls back down into a collection sump 210 that may include a heater element 212. At least some of the wash liquid is ejected in a manner that causes the arm to rotate. A recirculation path is provided via piping 214, pump 216 and piping 218 to move the wash liquid back to the wash arm 206. A rotatable rinse arm 220 with nozzles 222 is also shown, to which fresh rinsing liquid may be fed via a rinse line made up of fresh water input line 224, valve 226, boiler 228 and line 230. A controller 232 is also shown, which may typically be programmed to carry out one or more selectable ware cleaning cycles that generally each include at least a washing step (e.g., that may run for 30-150 seconds, followed by a rinsing step (e.g., that may run for 7-30 seconds), though many other variations are possible. Although the illustrated machine 10 includes only lower arms, such machines may also include upper rinse and wash arms shown schematically as 234 and 236. Such machines may also include other features, such as blowers for a drying step at the end of a ware cleaning cycle. Machines with hood type doors, as opposed to the illustrated pivoting door, are also known.

The warewash arm construction described in detail below can be used in such a batch-type machine, or any other type of warewash machine in which a rotating spray arm is desired.

Referring to FIGS. 5, 6, 9, and 10, one embodiment of a warewash machine arm for ejecting liquid in a warewash machine is disclosed. The arm includes an arm body 10 formed to provide an elongated internal liquid space 11 along an arm axis. The liquid space 11 is in communication with one or more nozzle orifices 12 for ejecting liquid from the arm and a mount opening 13. A warewash arm mount includes a base 14, cover 30 and internal actuator. The base 14 is mounted on arm body 10 and includes a top base surface 15, a bottom base surface 16, a base edge 17, and a base port 18 passing from top base surface 15 to bottom base surface 16 wherein base port 18 is aligned with mount opening 13. A first actuator 19 and second actuator 20 are movably mounted on top base surface 15. Actuator 19 includes a top surface 21, a bottom surface 22, an outer edge 23 and a port 24 passing from top surface 21 to bottom surface 22. Another actuator 20 includes a top surface 25, a bottom surface 26, an outer edge 27 and a port 28 passing from top surface 25 to bottom surface 26. Actuator port 24 and actuator port 28 are aligned with mount opening 13 and base port 18. Actuators 19, 20 are symmetrically disposed with respect to base port 13, and resiliently biased one against each other. Cover 30 is in overlying contact with actuators 19 and 20. The cover includes a top surface 31, a bottom surface 32 and a port 34 passing from top surface 31 to bottom surface 32. Cover 30 is mounted to base 14 and cover port 34 is aligned with mount opening 13, base port 18, actuator port 24, and actuator port 28.

In the illustrated embodiment, base 14 and cover 30 are shaped to define at least one degree of symmetry. For example base 14 and/or cover 30 are symmetric about a rotational axis passing through base port 18 and cover port 34, respectively. In another embodiment, base and/or cover are symmetric about at least one plane of symmetry. Components disposed in such symmetry relationships allow the device to be balanced and/or rotate smoothly and/or with minimized wear in use.

Actuators 19 and 20 are mounted on base 14 in an opposed relationship about a rotational axis (e.g., 180 degrees apart). In other embodiments, there may be more than 2 actuators in rotationally symmetric relationship (e.g., 3 actuators 120 degrees apart).

Figure 6:
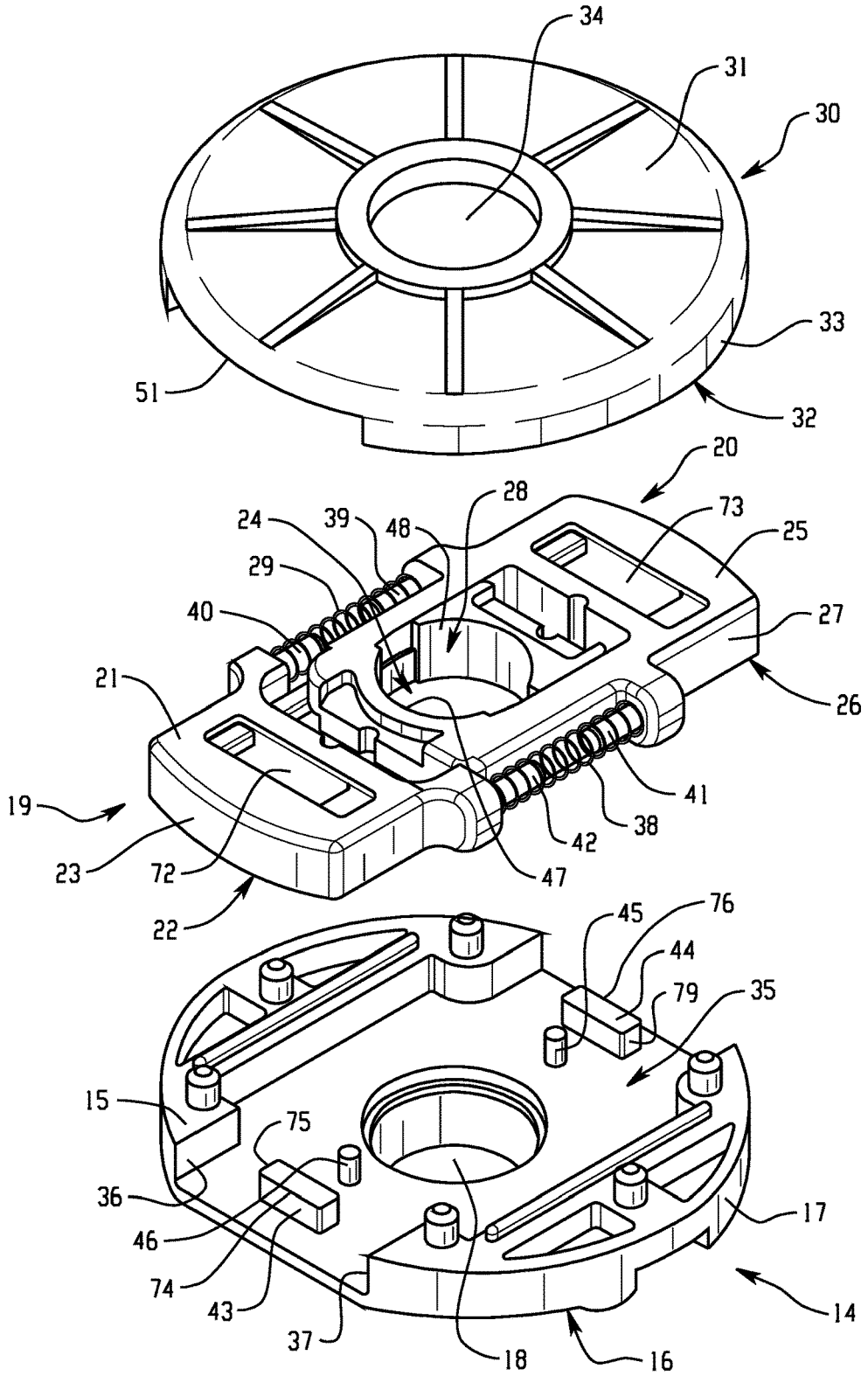
FIG. 6 is an exploded view of one embodiment of a warewash machine arm actuator mechanism.
Figure 11:
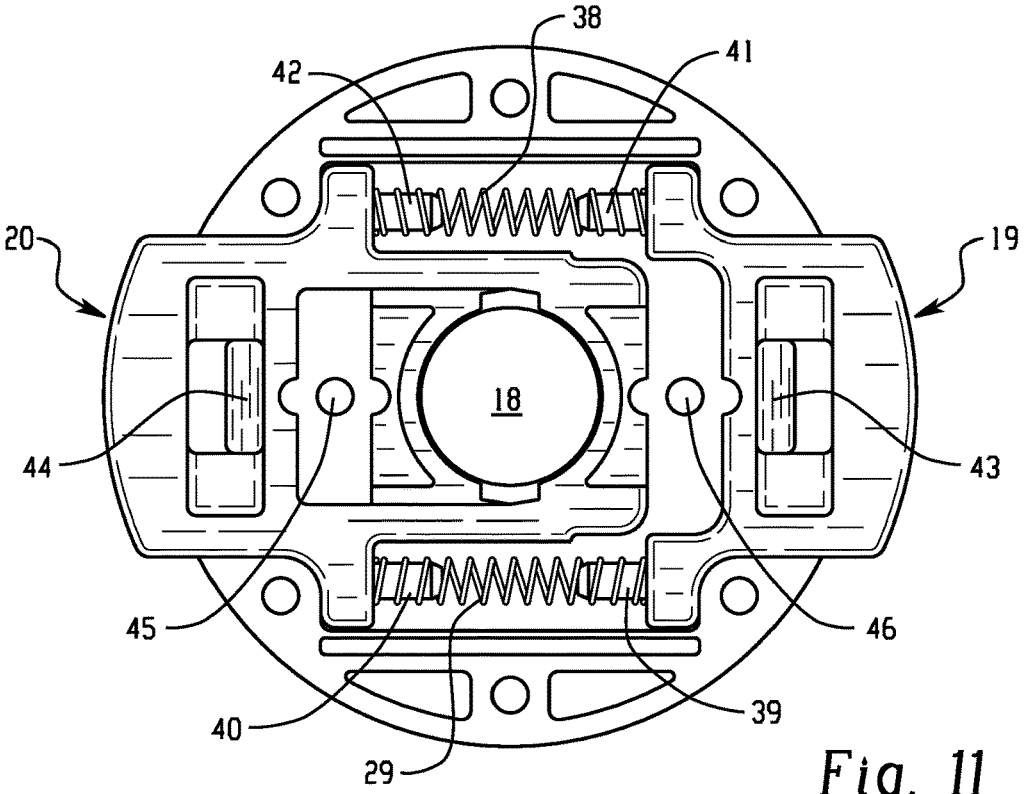
FIG. 11 is a top view of an embodiment of the actuator mechanism of FIG. 6, without the cover, in a closed position and ready for use in a warewash machine.
Figure 12:
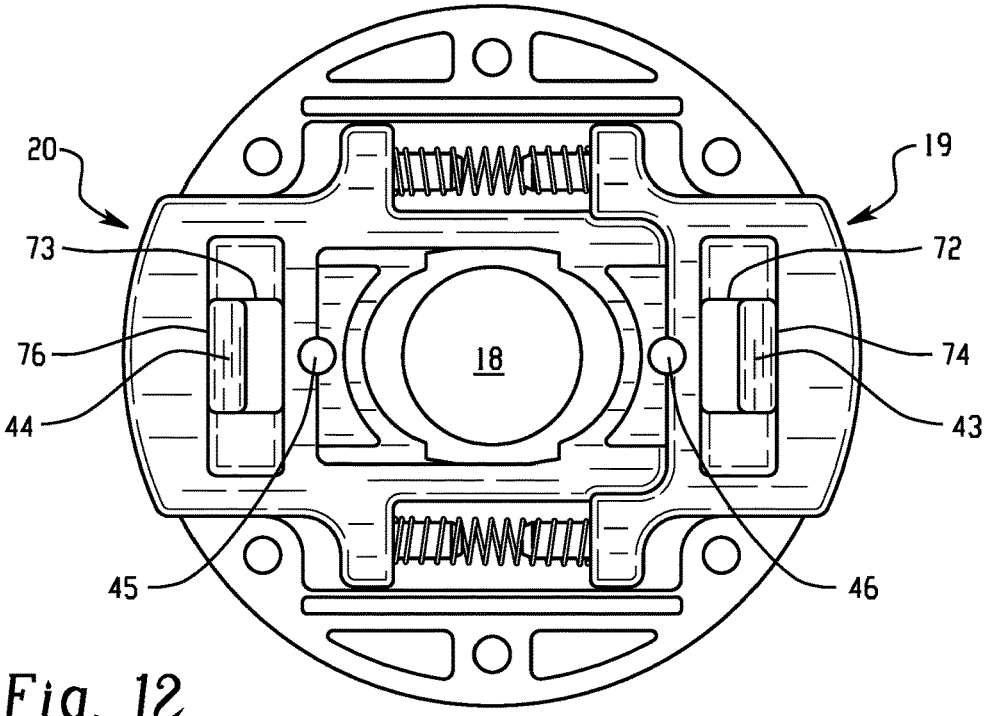
FIG. 12 is a top view of an embodiment of the actuator mechanism of FIG. 6, without the cover, in an open position for removal or attachment of the warewash mount to a warewash machine liquid supply assembly.

Actuators 19 and 20 are arranged in a partially overlapped, slidable relationship. Referring now to FIGS. 6, 11 and 12, actuators 19 and 20 overlie base 14 and are in contact with top base surface 15. Top surface 21 of actuator 19 is in contact with bottom surface 26 of actuator 20 in the area surrounding the ports 24 and 28. The two actuators are biased in a normally closed position, with the exterior end portion of each actuator biased away from the center axis of the device and the interior end portion of each actuator, which is positioned on an opposite side of the axis relative to its associated exterior end portion, biased toward the center axis of the device due to the force of springs 29 and 38 pushing actuators 19 and 20.

The illustrated actuators 19 and 20 lie within a channel 35, defined within base 14. In a normal position, outer edge 23 and outer edge 27 are in register with and/or abut lips 36 and 37 of channel 35. Spring 29, held by pegs 39 and 40 and spring 38, held by pegs 41 and 42, work in concert to bias actuators 19 and 20 to their normal position. In operation, the exterior end portions of the actuators 19 and 20 may be moved toward the center axis of base port 18, thus moving the interior end portions of the actuators away from the center axis of base port 18, placing the device in an actuated, or open, position. Actuation stops, e.g., 43, 44, 45 and 46, protruding from channel 35, may be provided to limit the lateral movement of actuators 19 and 20 from a normal position to an actuated position. In other words, by the use of stops, the springs 29 and 38 are not over-compressed. In the illustrated embodiment, faces 74 and 76 of cuboid stops 43 and 44 stop actuator lateral/inward movement by engaging the longer inside edges of stop ports 72 and 73, respectively. Faces 75 and 79 of cuboid stops 43 and 44 engage the shorter inside edges of stop ports 72 and 73 to prevent misalignment of actuators 19 and 20 through their actuated movement in use.

Figure 2:
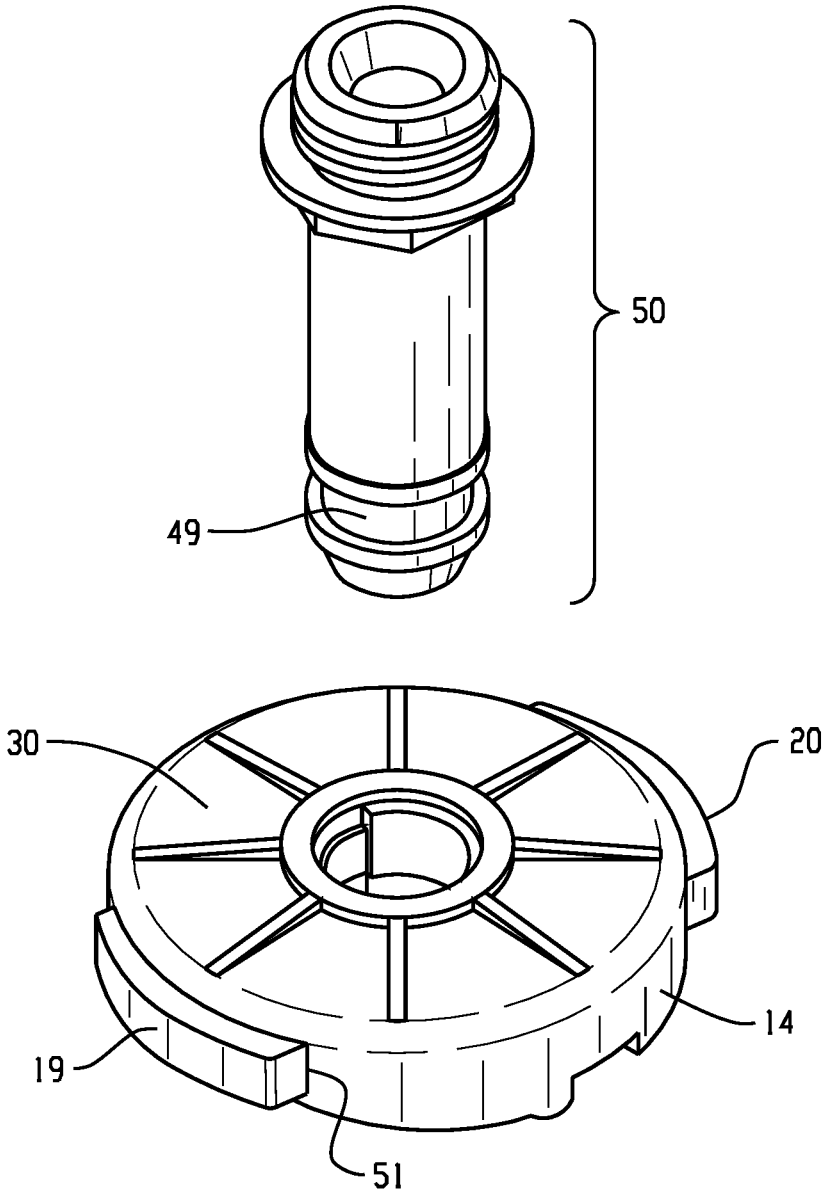
FIG. 2 is an exploded view of one embodiment of a warewash machine arm mount and a warewash machine liquid supply assembly.
Figure 3:
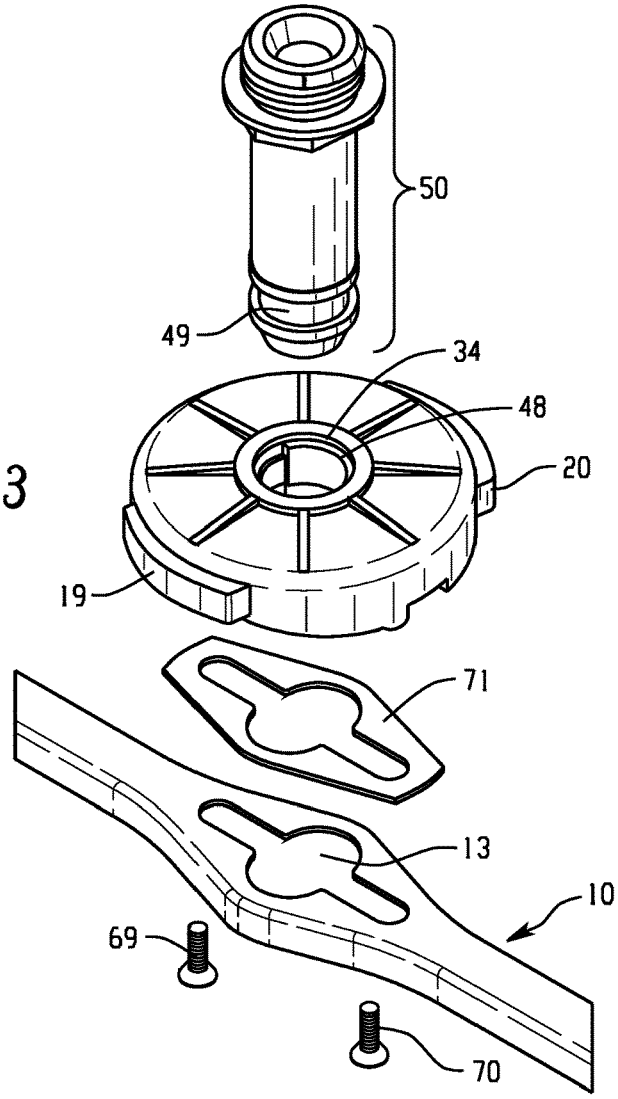
FIG. 3 is an exploded view of one embodiment of a warewash machine arm, warewash machine arm mount, gasket and a warewash machine liquid supply assembly.
Figure 4:
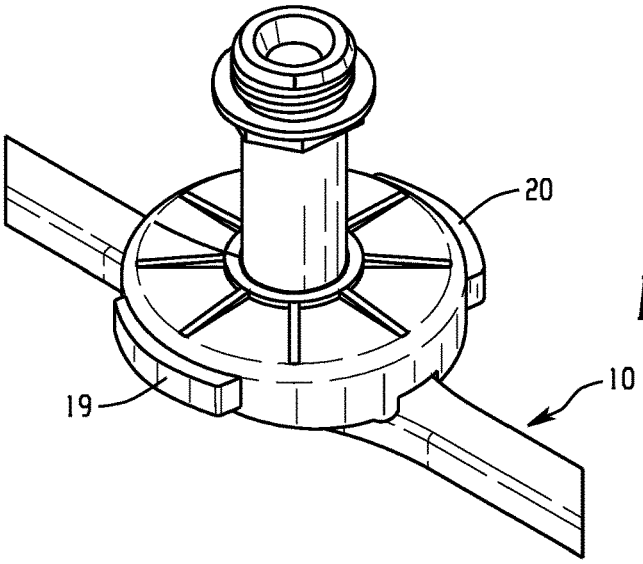
FIG. 4 is a top view of one embodiment of a warewash machine arm, warewash machine arm mount, and a warewash machine liquid supply assembly.
Figure 5:
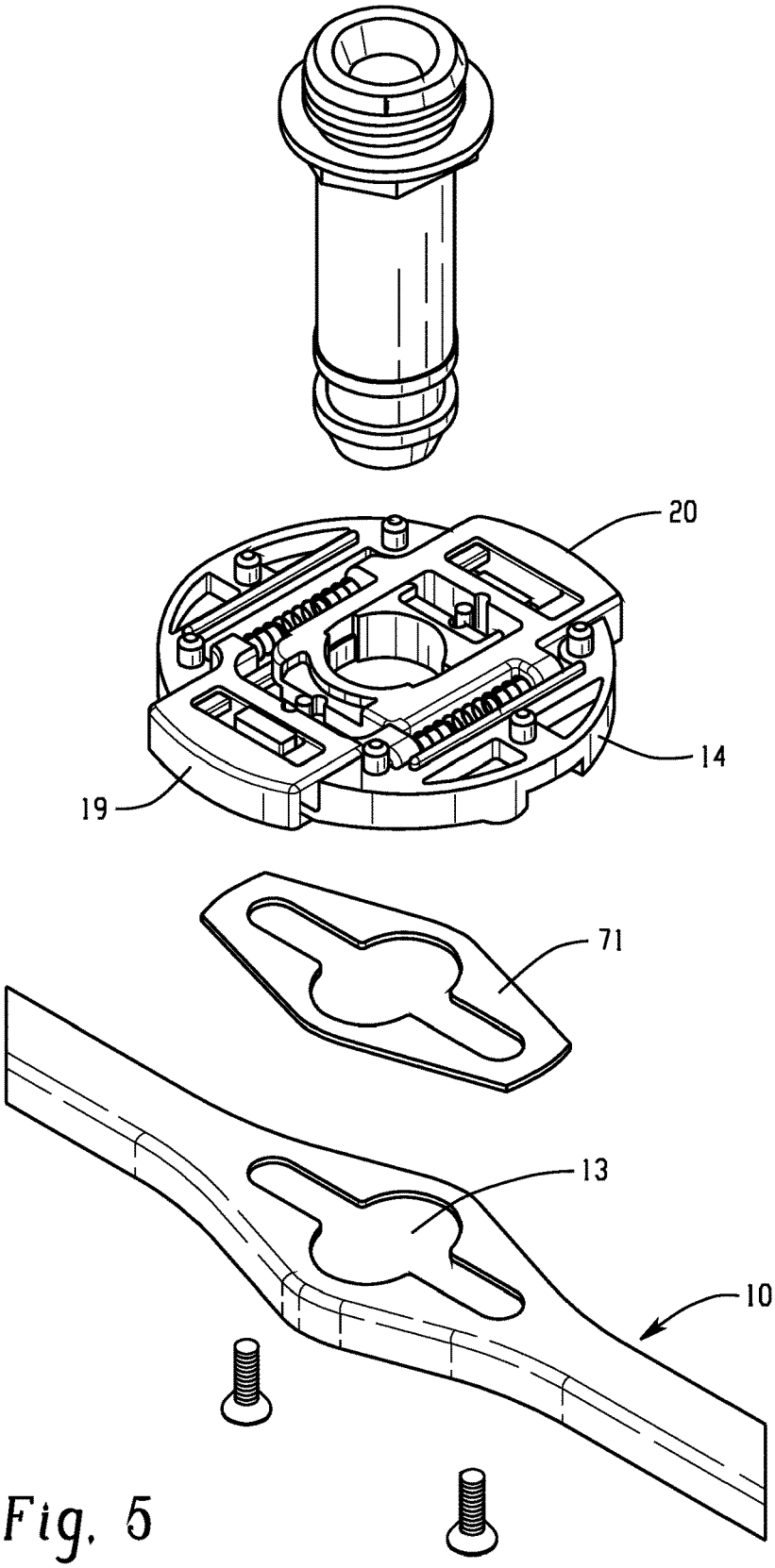
FIG. 5 is an exploded view of one embodiment of a warewash machine arm, warewash machine arm mount, gasket and a warewash machine liquid supply assembly wherein a cover of the mount housing is removed.

Referring now to FIGS. 2 and 6, actuator ports 24 and 28 define, respectively, first and second bearing latch edges 47 and 48. When in a normal position, bearing latch edges 47 and 48 together define a partial annulus that, in use, engages an annular bearing surface 49 of a warewasher liquid supply shaft assembly 50. Cover 30 overlies actuators 19 and 29 and is mounted to base 14. Cover edge 33 removably overlaps base edge 17 and may be held on by friction. In alternative embodiments, base 14 is glued to cover 30 or cover 30 is attached to base 14 with any fastening means known the person of ordinary skill in the art, for example screws, rivets, locking pins, and the like. The exterior ends of actuators 19 and 29 extend radially outward beyond cover edge 33 and base edge 17 through slots 51. In this way, actuator edges 22 and 27 may be manually pushed in and the alignment of the actuators maintained.

Figure 7:
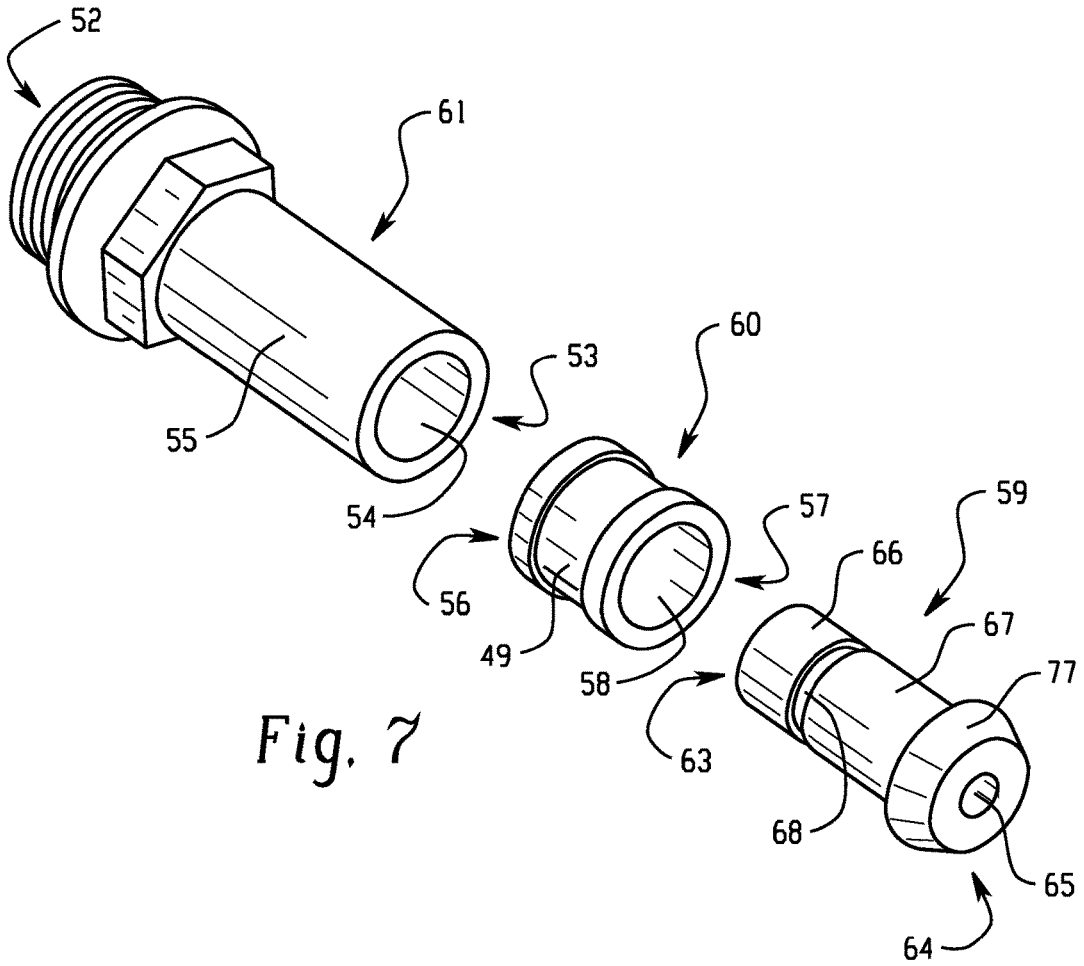
FIG. 7 is a top view of a warewash machine liquid supply assembly.
Figure 8:
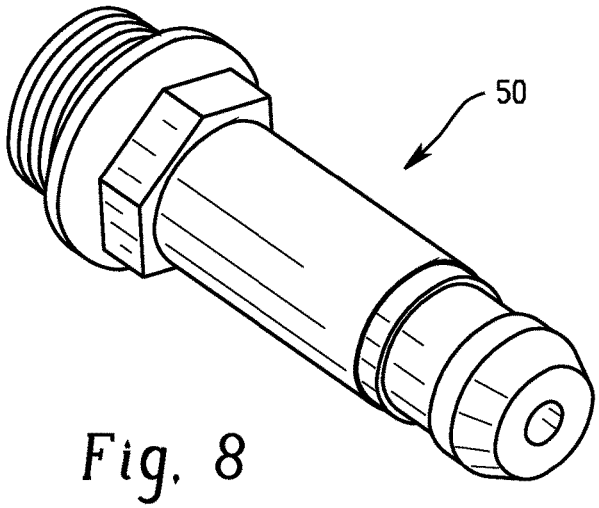
FIG. 8 is an exploded view of a warewash machine liquid supply assembly.

Referring now to FIGS. 7 and 8, a liquid supply shaft assembly 50 is disclosed, which assembly includes a liquid supply tube 61 having a liquid inlet end 52, a liquid outlet end 53 an inner tube surface 54 and an outer surface 55. A sleeve bearing 60 includes a first end 56, a second end 57, an exterior surface 49, and an inner surface 58. First end 56 is aligned with and abuts liquid outlet end 53 of tube 61. A hollow axle shaft 59 removably fixes sleeve bearing 60 to liquid supply tube 61. Liquid inlet end 52 includes a means to attach end 52 to an inlet liquid supply line in a warewash machine (e.g., end 52 has a threaded surface for screw-like attachment to a correspondingly threaded female port in a warewash machine). Ends 56 and 57 of sleeve bearing are of greater diameter than the diameter of surface 49, thus forming two annuli demarcating surface 49. Ends 56 and 57 are preferentially chamfered, thus allowing the device to operate smoothly as will be described in more detail below.

Hollow axle shaft 59 includes end 63, end 64, an inner tube surface 65, a supply shaft outer surface engagement region 66 proximate to first end 63 and a sleeve bearing region 67 positioned between supply shaft outer surface engagement region 66 and second axle shaft end 64. An annular groove 68 may be provided between supply shaft outer surface engagement region 66 and sleeve bearing engagement region 67. Annular groove 68 is shaped to receive an O-ring, which in assembly provides a substantially liquid-tight seal between axle shaft 59 and liquid supply tube 61. In assembly, shaft end 63 is pushed through the ends of sleeve bearing 60 such that supply shaft outer surface engagement region 66 is positioned within and in contact with supply shaft inner tube surface 54 and bearing region 67 is positioned within the sleeve bearing 60. Sleeve bearing 60 may be manufactured of a substantially low-friction material, for example, a plastics, a fluoropolymer, a polytetrafluoroethylene; or, in another embodiment an ultra-high molecular weight polyethylene; or a nylon. Sleeve bearing 60 will rotate freely about the bearing region 67 of the shaft 59.

Referring now to FIGS. 3, 4, 9 and 10, in an embodiment, a combination of warewash machine arm 10 mounted on liquid supply shaft assembly 50 is shown. Screws 69 and 70 pass through arm body 10 and secure arm body 10 to base 14. A gasket 71 may be mounted in register with mount opening 13 to provide a substantially watertight seal between arm body 10 and base 14. Other sealing arrangements could be used.

End 64 of the supply shaft assembly includes an chamfered edge 77. To install a warewash arm on the supply shaft assembly 50, the central opening of the arm mount or hub is axially moved onto the end 64 causing the chamfered edge 77 to engage the partial annulus formed by bearing latch edges 47 and 48, pushing latch edges 47 and 48 outward slightly. When the latch edges have fully passed the chamfered edge 77 and the end lip of the sleeve bearing, springs 29 and 38 return the actuators to a closed position, causing bearing latch edges 47 and 48 to contact sleeve bearing outer surface 49, holding the warewash arm onto the liquid supply shaft assembly in a manner that permits the arm to rotate via the permitted rotation of the sleeve bearing 60. To remove the arm from the liquid supply assembly, the actuators are manually pushed inward as described above so that latch edges 47 and 48 move outward far enough to clear the end lip of the sleeve bearing to permit the arm mount to move axially off of the liquid supply shaft assembly. Notably, the action that enables arm removal is a simple, ergonomic squeezing operation of the diametrically opposed actuators that can be performed with one hand.

Figure 9:
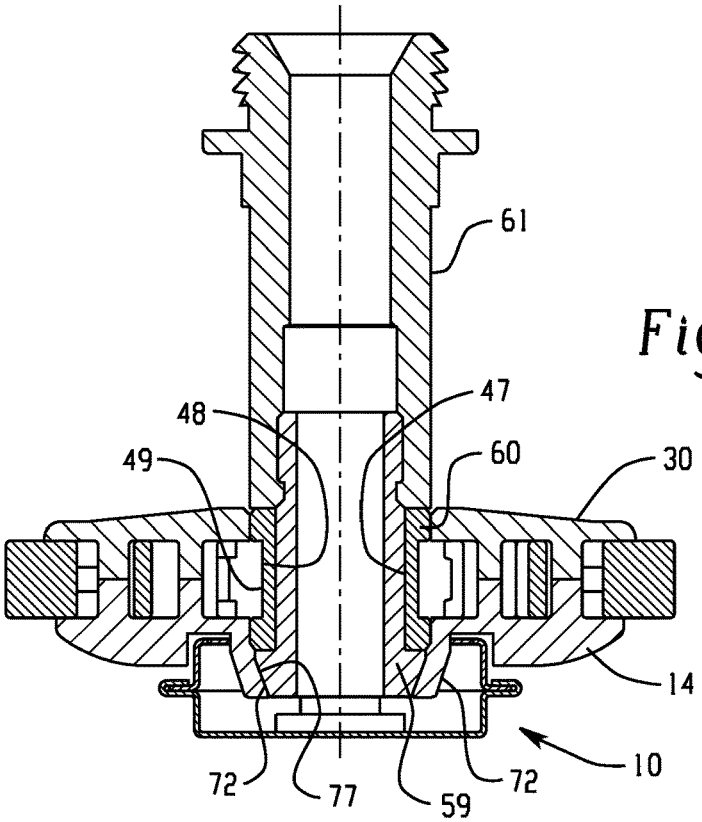
FIG. 9 is a cross section of the warewash machine arm, warewash machine arm mount, and a warewash machine liquid supply assembly of FIG. 4, viewed on a cross sectional plane perpendicular to the arm axis.
Figure 10:
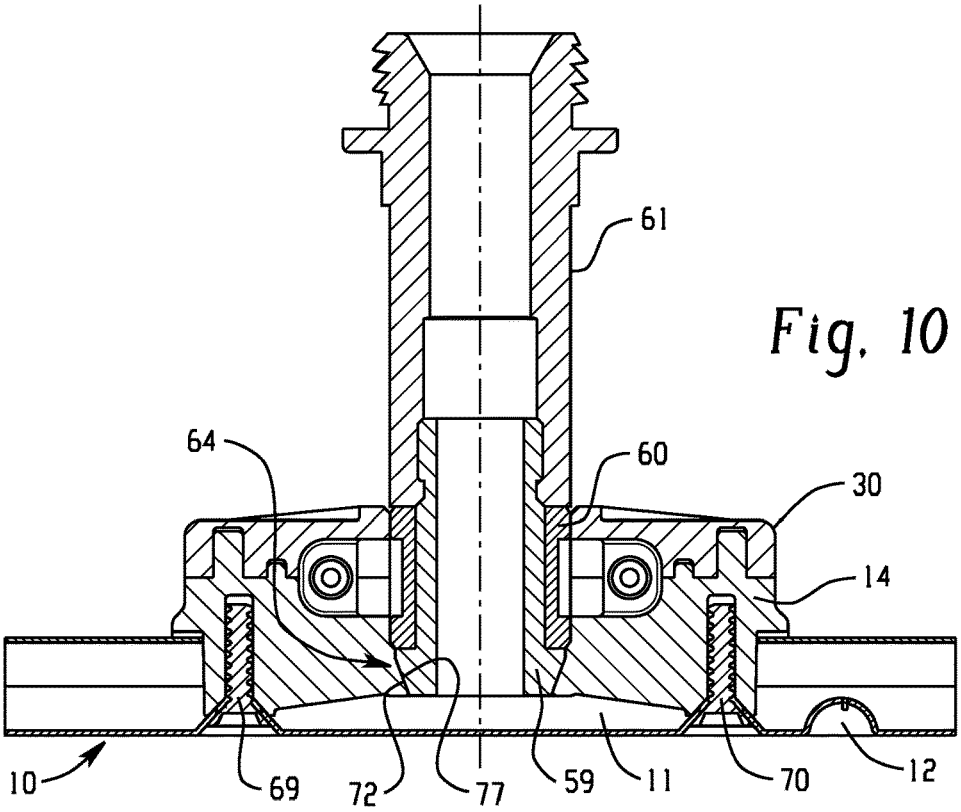
FIG. 10 is a cross section of the warewash machine arm, warewash machine arm mount, and a warewash machine liquid supply assembly of FIG. 4, viewed on a cross sectional plane along the arm axis.

The port 18 in base 14 is defined in part by a tapered edge 72 per FIG. 9. Chamfered edge 77 is substantially flush with tapered edge 72 and in alignment with mount opening 13. In this manner, liquid supply shaft assembly 50 cannot pass into liquid space 11 of arm body 10.

A warewash machine including the foregoing liquid supply shaft assembly 52 and the described warewash machine arm and associated mount facilitates straightforward and convenient installation and removal of the arm for cleaning and/or replacement. The above mechanism allows a rotating rinse arm to be easily attached and removed by the user, without the use of tools, for cleaning or replacement. The user can install the arm by either pushing the rinse arm hub mechanism onto a supply stem or by depressing two opposing buttons on the hub mechanism to install on the supply stem. To remove the arm the user depresses two opposing buttons on the hub mechanism and removes the arm off of the supply stem.

This device allows for advantages over other quick latching-type mechanisms. The mechanism is very low profile allowing for a quick-latch mechanism in a very tight space. More consistent spinning and improved life the mechanism is provided by separating the spinning from the latching. Rather than have the latches both hold the arm in and be the bearing surface for spinning, the described mechanism has a sleeve bearing that is attached to the supply shaft and that provides for the spinning, and the mechanism latches only have to hold the rinse arm to the bearing. The rinsing fluid enters the rinse arm beyond the latching mechanism and is somewhat separated from the mechanism to limit the interaction of the fluid and the mechanism. The mechanism housing incorporates features that both act as a positive stop for the latching action and provide for support for the mechanism to allow correct operation even when subjected to outside stress.

Figure 13:
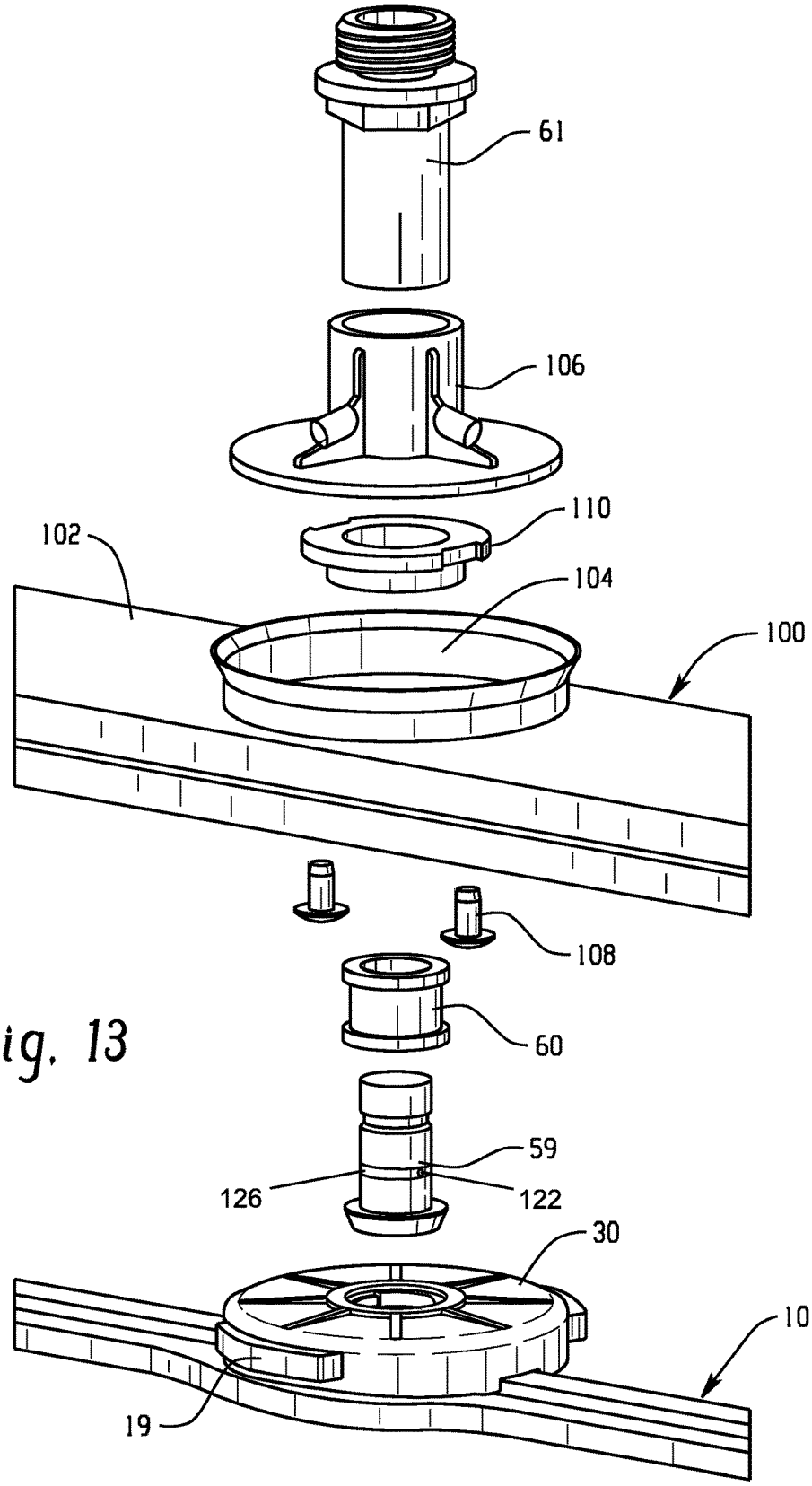
FIG. 13 is a partially exploded view of a hanging rinse arm and wash arm combination.
Figure 14:
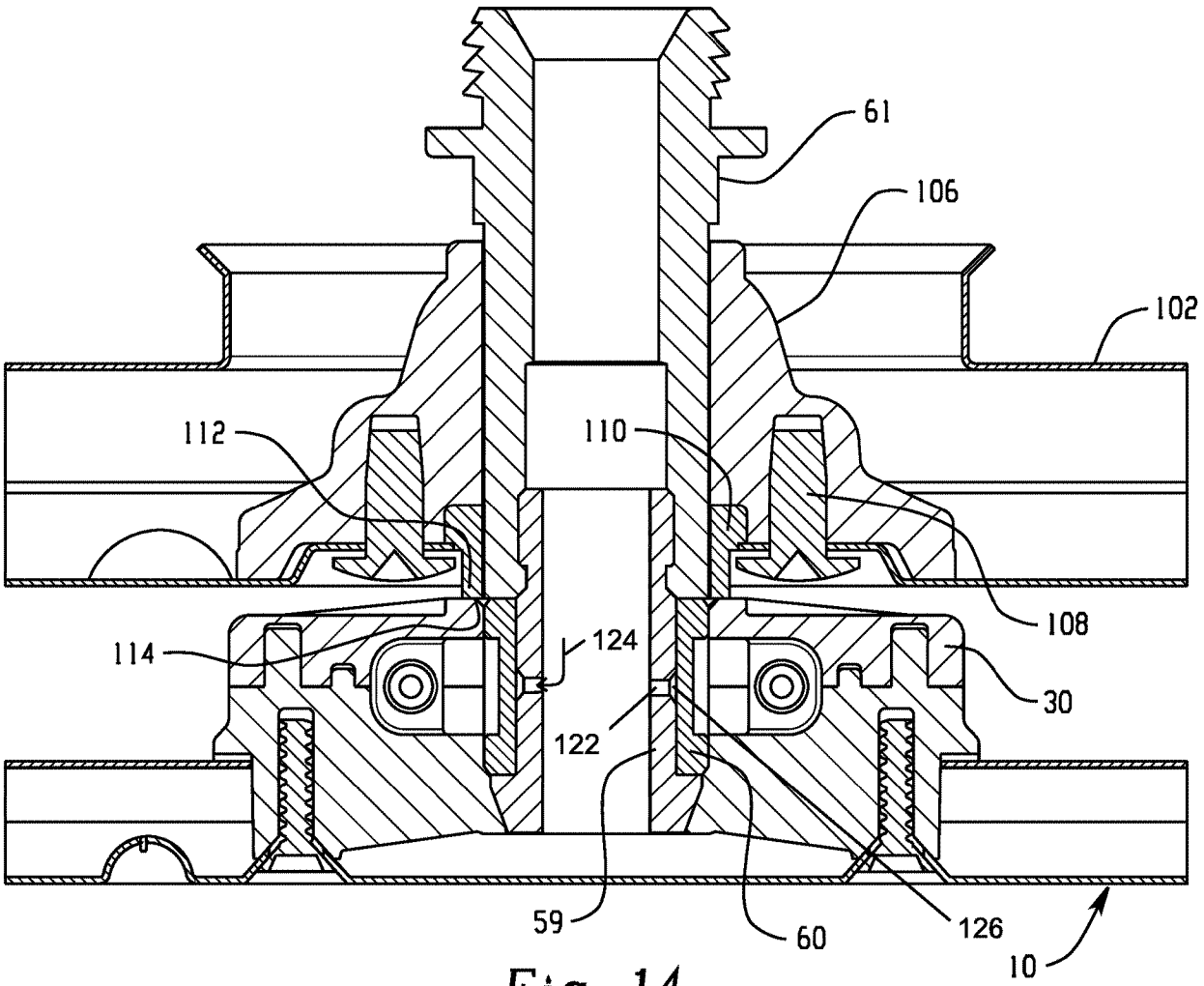
FIG. 14 is a cross-section of the assembled rinse arm and wash arm combination of FIG. 13.

Referring now to FIGS. 13 and 14, a combination rinse arm and wash arm arrangement is shown, where the contemplated arrangement utilizes a downwardly extending supply shaft assembly 61, 60, 59 on which the rinse arm 10 is mounted toward the bottom via the arm mount described above. Above the rinse arm 10, a wash arm 100 is also mounted along the supply shaft assembly. The wash arm 100 includes an elongated arm body 102 with an upper opening 104 in which a wash arm mount hub 106 is located, the mount hub 106 secured to a lower portion of the arm body 102 via screws 108. A wash arm bushing 110 sits within the mount hub 106. As shown, a bottom portion 112 of the bushing 110 protrudes from a lower opening of the arm body 102 slightly and provides a downwardly facing annular bearing surface 114 that sits atop the upper surface of the top cover 30 of the rinse arm mount. The bushing 110 may be formed of a PTFE or other low friction material to provide a low friction interface between the wash arm and rinse arm, given that the wash arm is supported on the shaft assembly by the rinse arm. This arrangement facilitates ease of rotation of both the wash arm and the rinse arm as desired. When the rinse arm is released and removed, the wash arm is no longer held on the supply shaft assembly 50 and can also be removed.

The arrangement of FIGS. 13 and 14 also shows an additional bearing feature that may be incorporated into the arrangement. Specifically, the axle shaft 59 of the supply shaft assembly includes one or more fluid passages 122 through its tubular wall in the region that aligns with the sleeve bearing 60. The passages 122 act as bleed ports through which rinse fluid may travel, as per arrow 124, to reach the interface of the external surface of the axle shaft 59 and the internal surface of the sleeve bearing 60, thereby lubricating the interface of the two cylindrical surfaces to improve the spinning characteristic of the sleeve bearing 60 about the axle shaft 59. The axle shaft 59 may also include a recessed peripheral groove 126 in which the passages 122 are located to facilitate peripheral flow of rinse fluid about the axle shaft 59 to assure that the rinse fluid reaches the full peripheral extent of the interface of the two cylindrical surfaces. In addition to acting as an interface lubricant, the rinse fluid delivered through the passages 122 also helps to flush out the bearing interface to reduce the likelihood that food soils will migrate into and/or build up within the interface, thereby assuring a continually strong and unhindered rotating characteristic of the sleeve bearing 60 over the long term.

It is to be clearly understood that the above description is intended by way of illustration and example only, is not intended to be taken by way of limitation, and that other changes and modifications are possible. For example, while the primary embodiment shown above depicts the shaft and arm arrangement in a downwardly extending or hanging orientation (e.g., as in the case of an upper rinse arm and upper wash arm of a machine), the same shaft and arm arrangement can be used in an upwardly extending orientation (e.g., in the case of a lower rinse arm and lower wash arm of a machine).

What is claimed is:

1. A warewash machine arm for ejecting liquid in a warewash machine, the arm comprising:

an arm body formed to provide an elongated interior liquid flow space along an arm axis, the arm body including one or more liquid ejection orifices;

a mount hub connected to the arm body, the mount hub including a mount opening and a releasable latch mechanism that includes a first slidable actuator mounted for linear sliding movement relative to the mount opening and a second slidable actuator mounted for linear sliding movement relative to the mount opening, each of the first slidable actuator and the second slidable actuator having an interior end portion biased toward an axis of the mount opening and an exterior end portion biased away from the axis of the mount opening, such that movement of the exterior end portion toward the axis of the mount opening slides the interior end portion away from the axis of the mount opening, enabling latch mechanism release via a squeezing operation of the exterior end portion of the first slidable actuator toward the exterior end portion of the second slidable actuator.

2. The warewash machine arm of claim 1 wherein a compression spring is compressed between a portion of the first slidable actuator and a portion of the second slidable actuator.

3. The warewash machine arm of claim 2 wherein the exterior end portion of the first slidable actuator is diametrically opposed to the exterior end portion of the second slidable actuator.

4. A warewash machine including the warewash machine arm of claim 1, the machine further comprising a supply shaft assembly including a rotatable sleeve bearing, the arm mounted to the rotatable sleeve bearing via the first and second slidable actuators engaging the rotatable sleeve bearing.

5. The warewash machine of claim 4 wherein the rotatable sleeve bearing is mounted about a hollow axle shaft having an end portion configured to prevent axial removal of the rotatable sleeve bearing.

6. The warewash machine of claim 5 wherein the supply shaft assembly extends downward from an upper portion of the warewash machine, the arm is a rinse arm, and a wash arm assembly is also mounted on the supply shaft assembly, the wash arm assembly supported on the supply shaft assembly by the rinse arm.

7. The warewash machine of claim 6 wherein the wash arm assembly includes a bushing having a lower portion extending downward from an arm body of the wash arm assembly, the bushing including a downwardly facing bearing surface that sits atop an upper portion of the arm mount hub.

8. The warewash machine arm of claim 1 wherein the exterior end portion of the first slidable actuator and the interior end portion of the second slidable actuator are located on a first side of the mount opening, and the exterior end portion of the second slidable actuator and the interior end portion of the first slidable actuator are located on a second side of the mount opening, the second side being opposite the first side.

9. A warewash machine arm for ejecting liquid, comprising:

an elongated arm body including an elongated interior liquid flow space along the elongated arm body and one or more liquid ejection orifices;

an arm mount hub connected with the arm body and having a mount opening and a releasable latch mechanism that includes first and second slidable actuators, each actuator having an interior end portion biased toward an axis of the mount opening and an exterior end portion biased away from the axis, such that sliding the exterior end portion toward the axis slides the interior end portion away from the axis, enabling latch mechanism release via a squeezing operation of the exterior end portions each other with one hand.

* * * * *